US006611236B1

(12) United States Patent
Nilsson

(10) Patent No.: US 6,611,236 B1
(45) Date of Patent: Aug. 26, 2003

(54) ANTENNA DEVICE

(75) Inventor: Mats Nilsson, Saltsjöbaden (SE)

(73) Assignee: C2SAT Communications AB, Nacka (SE)

( * ) Notice: Subject to any disclaimer, the term of this patent is extended or adjusted under 35 U.S.C. 154(b) by 0 days.

(21) Appl. No.: 09/744,242

(22) PCT Filed: Aug. 6, 1999

(86) PCT No.: PCT/SE99/01341

§ 371 (c)(1),
(2), (4) Date: Jan. 29, 2001

(87) PCT Pub. No.: WO00/10224

PCT Pub. Date: Feb. 24, 2000

(30) Foreign Application Priority Data

Aug. 13, 1998 (SE) ..... 9802720

(51) Int. Cl.[7] ..... H01Q 3/00
(52) U.S. Cl. ..... 343/757; 343/765; 342/81
(58) Field of Search ..... 343/757, 758, 343/763, 765, 766, 882; 342/74, 81; H01Q 3/00, 3/22

(56) References Cited

U.S. PATENT DOCUMENTS 5,521,604 A 5/1996 Yamashita ..... 342/359

FOREIGN PATENT DOCUMENTS

| | | |
|---|---|---|
| DE | 39 09 685 | 9/1990 |
| SE | 9402587-1 | 1/1996 |
| SE | 9702268-5 | 5/1998 |

*Primary Examiner*—Michael C. Wimer
(74) *Attorney, Agent, or Firm*—Jacobson Holman PLLC

(57) ABSTRACT

An antenna arrangement includes an antenna reflector (10), a transceiver element (11) and a signal detection unit (12) having a signal converter (121–122) and a computing unit (123) for generating in response to incoming signals control signals for controlling the alignment of the antenna reflector (10) with a target object. The signal converter (121–122) is adapted to reduce its bandwidth automatically and incrementally from a requisite maximum frequency range to a narrow band frequency range. Changes in the direction of the antenna reflector are detected through the medium of a movement detection unit (13) that includes 3d-sensors (131, 132, 133). Mechanical control of the alignment direction of the antenna reflector (10) is effected with the aid of a drive unit (15).

15 Claims, 2 Drawing Sheets

11
12
121
131
132
133
13
130
122
1230
123
171
172
173
174
17
170
1231
141
140
1241
124
14
1240
142
143
181
182
183
184
18
180
125
1251
1250
150
15
151
152
153
154

ANTENNA DEVICE

FIELD OF INVENTION

The present invention relates to an antenna arrangement and more particularly to an antenna arrangement that includes an antenna reflector, an antenna holding unit, a transceiver element, a sensor unit and a signal detecting unit for processing signals arriving from a target and for generating on the basis of these signals control signals for guiding the antenna reflector into alignment with the target.

The antenna arrangement may be stationary or mounted on a moveable support surface, in other words intended for stationary equipment, land mobile equipment or marine equipment. The signal detecting unit includes a signal converter and a computing unit in series.

BACKGROUND OF THE INVENTION

It is known to use in antenna arrangements of this kind separate pointing and tracking systems whose purpose is to optimise the bearing between, e.g., land-based antenna arrangements and satellites so as to obtain correct alignment therebetween. The investment costs in achieving optimal dynamic pointing accuracy with the antenna arrangement in such systems is very high. This antenna pointing accuracy can be influenced by externally acting forces, such as movement of the antenna supporting surface, the wind, and wave motion, for example.

Because the matter concerns an antenna arrangement and a target that move relative to one another, high demands are placed on the pointing system. These high demands, in turn, limit the choice equipment for detecting signals arriving from the target to solely extremely expensive equipment.

In view of the requirement of high dynamic pointing accuracy, mono-pulse technology is used. However, this technology normally requires high investment in signal detection equipment such as broadband spectrum analysers and the like in achieving the effect desired.

Several known systems lack the possibility of correcting for the drift and instability of primarily non-linear components used to provide information on reference data, and consequently these systems drift continuously in time with temperature and current.

The object of the present invention is to provide an antenna arrangement of the aforesaid kind which will solve the problem of continuously tracking a moveable signal source that is located above the horizon from a mobile antenna arrangement that is mounted on a moving object at a reasonable cost, i.e. at a cost which is substantially lower than what can be achieved at the present time.

SUMMARY OF THE INVENTION

In the case of an antenna arrangement of the aforedescribed kind that includes a signal converter and computing unit, It is proposed in accordance with the invention that the signal converter is adapted to reduce its bandwidth automatically and incrementally, wherewith a given bandwidth is activated and retained until a desired input signal can be detected within said bandwidth. The inventive antenna arrangement includes a system of sensors for sensing undesired changes in the alignment of the antenna reflector on he one hand and for setting and retaining a desired antenna position relative to a target object on the other hand; a group of sensors placed on the rear side of the reflector, and a further group of sensors placed on respective rotational axles. Both sensor groups are adapted to be set to zero when an optimal signal detection is achieved thereby that the frequency range of the signal converter is subjected to incremental reduction from one given bandwidth to the next lower bandwidth until the best possible signal value has been obtained.

The sensor system provides information relating to changes in the position of the antenna arrangement caused by external forces. This positional change is defined on the basis of speed data ($\Delta Vx$; $\Delta Vy$; $\Delta Vz$) which are integrated in a computing unit to obtain relative positional data. With knowledge of the data relating to the speed changes that have occured within an established time period, determined by the report time of the sensor system, the aforesaid information can be used as the input values for a superordinate computerised system control unit which sends these values to a drive unit for compensating for changes in the position of the antenna arrangement caused by said external forces.

In this regard, the sensor system can be used for at least two different purposes, such as to compensate for the external forces acting on the antenna arrangement as a result of movement of the surface on which the antenna arrangement is mounted, and also to detect a predetermined desired and allocated movement pattern of the antenna reflector and its tracking or a signal target that has a known orbit and/or a movement pattern calculated with the aid of the computing unit during an ongoing period of time.

The sensor system thus has overall responsibility for the ability of the antenna arrangement to compensate continuously for the influence of all external forces on said arrangement.

Correspondingly, it is important to obtain correct compensation data for the temperature dependency, ageing, etc., of the electronic components included in said arrangement, which may otherwise generate system drifts with respect to output data from all electronic components included in the system.

BRIEF DESCRIPTION OF THE DRAWINGS

The invention will now be described in more detail with reference to the accompanying drawings, in which.

DESCRIPTION OF PREFERRED EMBODIMENTS

Figure 1:
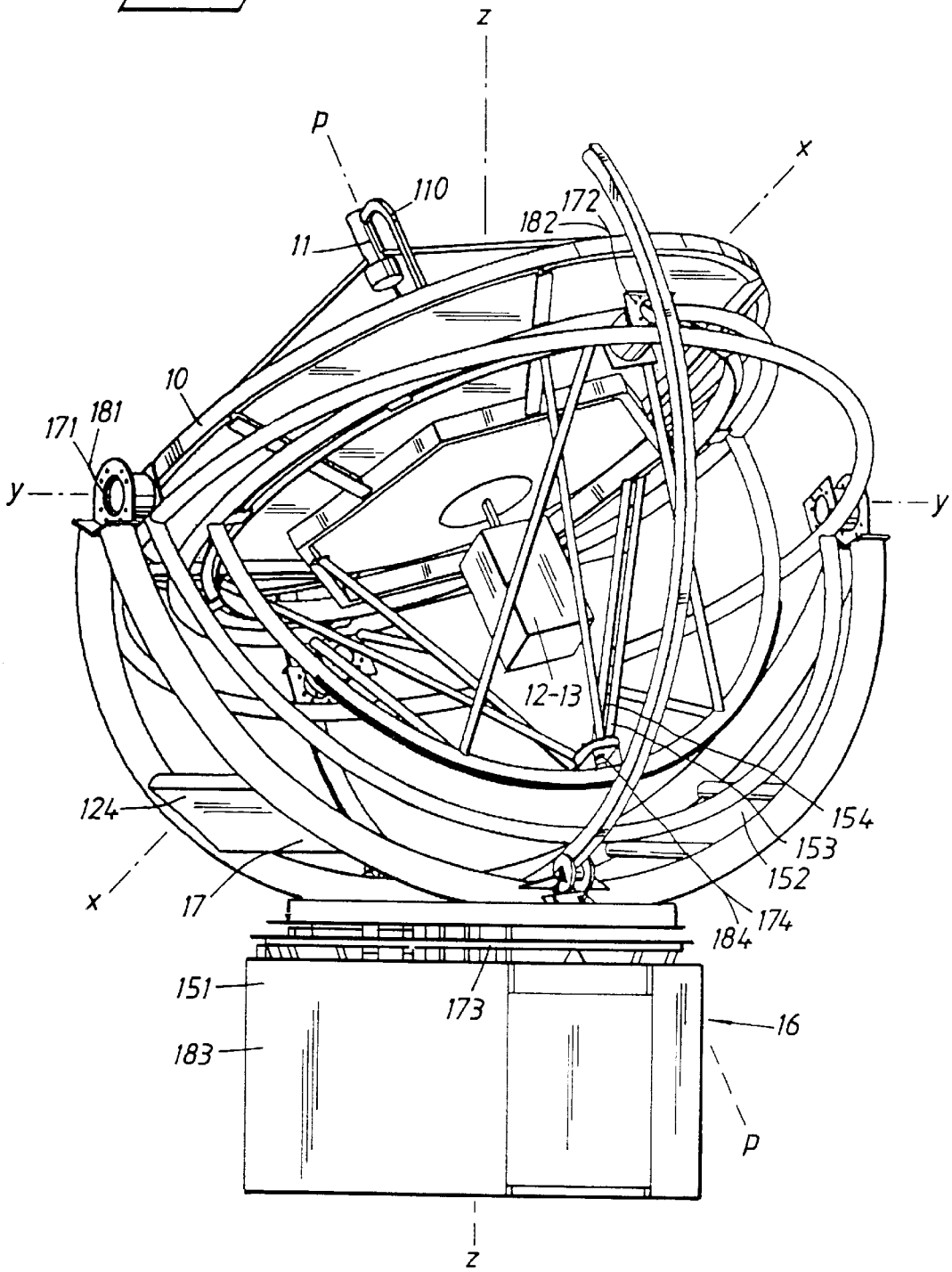
FIG. 1 illustrates an inventive antenna arrangement.

The antenna arrangement illustrated in FIG. 1 includes an antenna reflector 10, a transceiver horn 11 attached to the rear side of the reflector via an arm 110, a signal detection unit 12 and sensor unit 13 having sensors 131, 132, 133 (see FIG. 2) for three-dimensional detection of reflector movement, these two units also being attached as a combined unit to the rear side of the reflector 10. The sensors are adapted to detect movement around respective rotational axles caused by the influence or external forces.

The transceiver horn is suitably of the kind apparent from Swedish Patent Specification 9402587-1, "Feed Horn Intended Particularly for Two-Way Satellite Communications Equipment". The antenna reflector 10 is anchored mechanically to a base element 16 which, for instance, is anchored to a ship or to a vehicle and which includes a drive or power unit 15 having motors 151, 152, 153, 154 for mechanically controlling the alignment of the antenna reflector 10 with the intended target, e.g. a satellite, in response to control signals generated by a computing unit 123 included in the signal detection unit 12. The antenna reflector 10 and the transceiver horn 11 are combined to form a compact antenna unit suitably constructed in the manner apparent from Swedish Patent Specification 9702268-5, "A Device Comprising an Antenna Reflector and Transceiver Horn Combine in a Compact Unit".

Figure 2:
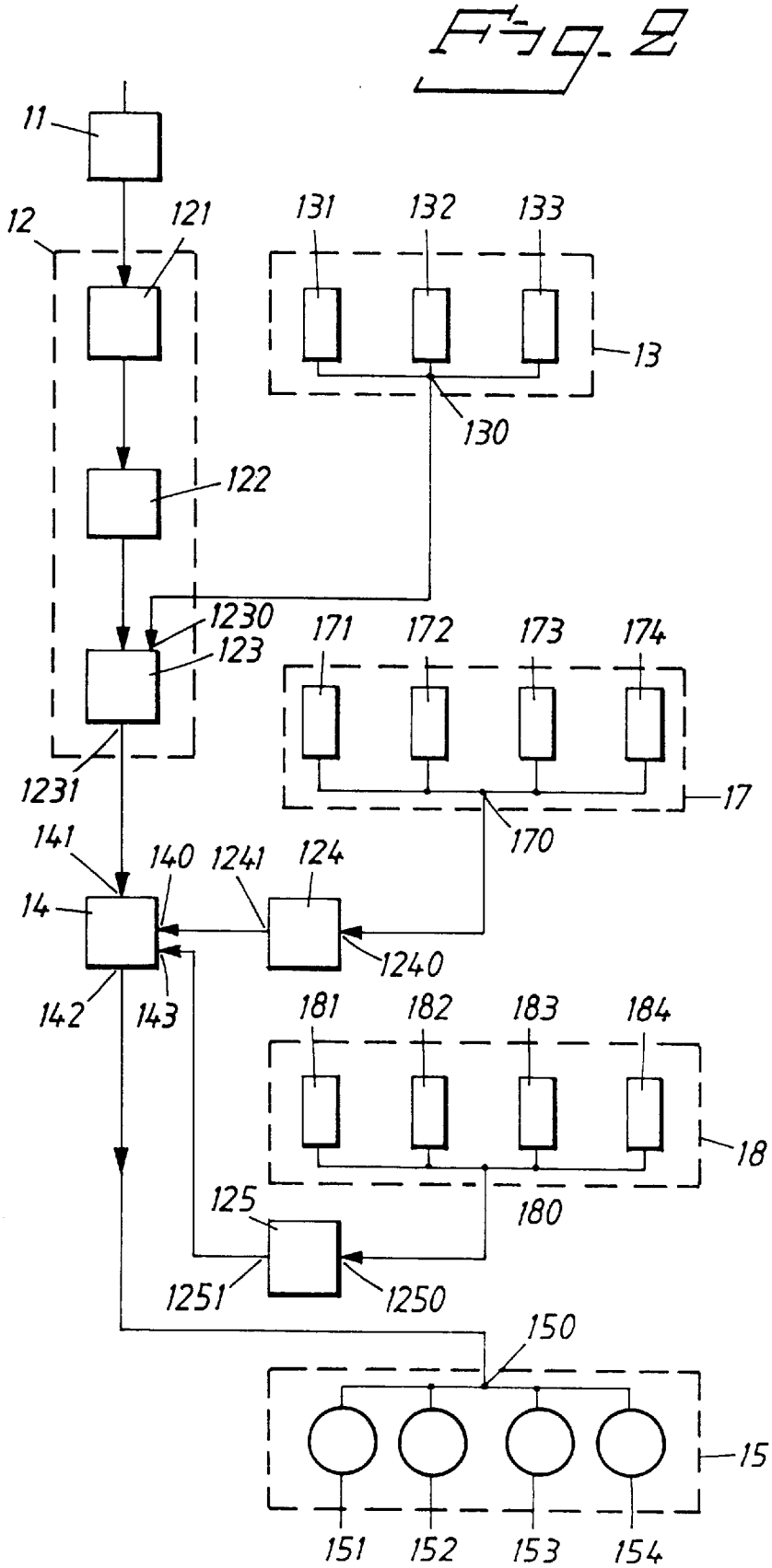
FIG. 2 is a block schematic illustrating a signal detection unit and sensor system detection units for movement compensation, included in the antenna arrangement.

The block schematic of FIG. 2 shows the signal detection unit 12 with series-coupled high-frequency signal converter 121, intermediate frequency signal converter 122 and the computing unit 123. Also shown is the movement detection unit 13 of the sensor system for the antenna reflector, including speed sensors and acceleration sensors for detection in three dimensions (ΔVx, ΔVy, ΔVz) and (Δax, Δay, Δaz) working with fibre optics and semiconductor elements respectively. All electronic equipment is subject to drift and instability in time. This requires more or less continuous correction in order to eliminate output data errors. The proposed signal detection unit 12 enables the requisite correction data to be produced for all sensors of the sensor system. The output side of the high frequency converter 121 is connected to the intermediate frequency part 122, where said automatic reduction in bandwidth is arranged to take place.

The transceiver horn 11 has signal outputs connected to signal inputs on the high-frequency signal converter 121, and the movement detection unit 13 of said sensor system for detecting movement of the antenna reflector has signal outputs connected to signal inputs on the computing unit 123, via conductors 130. The computing unit has outputs connected to the system control 14, which is connected on the output side to the drive unit 15. Thus, in principle, the computing unit 123 is connected on its output side to the input on the drive unit 15 that includes control motors 151–154 for transferring rotational movements to the moveable carts of the antenna arrangement.

The signal output 170 of a second movement detection unit 17 having sensors 171–174 is connected to he signal input 1240 of a second computing unit 124 having a signal output 1241 connected to the signal input 140 of the system control unit 14. The system control unit has a signal input 141 connected to a signal output 1231 on the computing unit 123 and a signal output 142 connected to a signal input 150 on the drive unit 15.

A third movement detection unit 18 having sensors 181–184 intended for detecting actual movement compensation effected in respect of each rotational axis y, x, z, p within the arrangement as a result of compensation data initiated via the system control unit 14, has a signal output 180 connected to a signal input 1250 on a third computing unit 125 that has a signal output 1251 connected to a signal input 143 on the system control unit 14.

The antenna reflector is initially aligned roughly with the target, with the aid of sensors which function to determine the latitude and longitude of the position in question (GPS), an inclinometer and compass. At the same time, the effect of external forces acting on the antenna as the antenna reflector is aligned roughly with the target are compensated for continuously. This movement compensation is effected by the movement detection unit of the sensor system for the different rotational axes of the compact antenna unit (azimuth z, elevation y, elevation x, polarisation pol).

The target is assumed to deliver a pilot frequency of, e.g., 12.541 GHz with a certain drift in the range of +/−40 kHz. The intermediate frequency signal converter 122 is set for a maximum frequency range of +/−8 kHz. The signal detection unit 12 is adapted to operate at the maximum value of the incoming signal (peak, signal curve target =0). Immediately this maximum value is encountered, (ΔVx; ΔVy; ΔVz) and (Δax; Δay; Δaz) are read-off for new corrected input values and sent to the system control 14, whilst, at the same time, the intermediate frequency signal converter 122 automatically reduces its frequency range to the next lower level, e.g., 3.75 kHz. Meanwhile, the plot frequency may have drifted slightly and the antenna support surface may have been moved in some direction, (for instance as a result of external forces acting on said support surface and therewith also on the antenna arrangement), but scanning now takes place within a narrower bandwidth and thereby with reduced incoming signal noise, so that the signal is detected more accurately.

The frequency range may optionally be further reduced to a lower level of 1.9 kHz, for instance. At each maximum value there is obtained, in the same way, a new output value from the movement detection unit 13 of the sensor system.

The advantage with this automatic "scaling" to the nearest lower selected bandwidth, controlled on the basis of the obtained and detected pilot frequency, is that signal noise is heavily suppressed, since less and less signal noise in relation to the amplitude (peak value) of the pilot frequency is allowed to disturb the detection of the pilot frequency.

If the pilot frequency should be lost within the scaling range, the scan returns to the nearest higher bandwidth.

Because the proposed signal detection procedure requires time to obtain a stable measuring result, it is imperative that the internal drift and instability of the superordinate sensor system and its movement detection unit are very slight in time, in order for the system to have time to provide a good signal detection result and therewith enable the drift and instability of all system components to be corrected. An essential basis for the cost efficiency that characterises the performance of the inventive antenna arrangement and the limited requirement of costly components lies in allowing the sensor system to have a superordinate role in relation to the signal detection unit, the main purpose of which is to correct the output data of the movement detection unit with respect to component drift and instability.

Only those units that are necessary in explaining the concept of the invention have been included in the description units that are normally included and that are necessary for commercial communications equipment via a satellite, for instance. The 3D-sensors 131–133 of the superordinate movement detection unit which are mounted in the same instrument casing as the signal detection unit 12 on the antenna reflector 10 together with the sensors 171–174 and the sensors 181–184 mounted on respective rotational axles, all send continuously correction data to the drive unit 15 via the system control 14 with a periodicity of less than 15 ms.

The equipment can be supplemented with a third 3D-sensor unit for certain applications, this third unit then being mounted on the support base. This provides greater resolution of output data (ΔVx; ΔVy; ΔVz) and (Δax; Δay; Δaz) and enables the mechanical flexibility of the antenna arrangement to be measured dynamically and continuously and the undesired movements within said arrangement to be corrected.

When the signal detection unit 12 has detected a relevant pilot signal from individual measuring horns in the receiver horn 11 and therewith calculated correction data and sent this data with a periodicity of less than 92 ms, a sufficiently good correction of the current position of the antenna arrangement can be initiated. This implies that the output data of the signal detection unit 12 is used as a so-called "true value", wherewith the output data values of the movement detection unit 13 are noted. In this regard, the movement detection unit 13 again assumes the superordinate function regarding the compensation data for forces acting externally on the antenna arrangement.

The aforesaid interaction takes place continuously and enables the use of a signal detection unit that has a variable bandwidth, therewith enabling a very narrow bandwidth to be used for optimum direction correction based on a stable but relatively weak pilot signal. The narrow bandwidth enables the detection of very weak pilot signals that would normally be drowned in ambient signal noise at larger bandwidths. This is made possible by the stable superordinate function of the sensor system over time.

The sensor system of the antenna arrangement further includes a number of sensors, namely an inclinometer with associated digital compass, that is mounted in direct connection with the base support of the arrangement above the interface of mounted shock and vibration dampers that separate the other parts of the arrangement from the support base and of joins to the mounting base. The arrangement also includes an external sensor unit consisting of a GPS unit (global positioning system) with associated digital compass. Together with the system control storage data for the programmed positional data of a target object, a theoretically calculated directional value can be obtained with respect to the target object concerned on the basis of the actual geographical position, although not with a higher degree of accuracy than that which can be obtained with the sensor system and its individual sensors. The twin digital compasses enable the sensors, here shown separate, to be calibrated, which means that the compass declination will be smaller than would otherwise be the case. As a result hereof, the method for calculating a directional value to a target object can be said to constitute a rough adjustment. When a gyro compass is available, the compass is connected to the system control and therewith enhances the accuracy of the compass course. This rough adjustment or setting is sufficient for the signal detection unit to find a pilot signal for optimised alignment with the target object.

When a gyro compass cannot be used because of environmental conditions, a bearing can be obtained with the aid of the inclinometer and the known elevation to the target transmitter. As the antenna rotates and the signal data is analysed by a broadband spectrum analyser, a unique transmitter combination is able to establish identity and thereby the bearing concerned.

The movement detection unit 13 and the movement sensors mounted on respect axles continuously transmit compensation data for those forces acting externally on the antenna arrangement during the whole of the introductory phase and continue to transmit said data so as to maintain the horizontal plane indicated by the inclinometers, which naturally also constitutes a prerequisite for setting the desired height of elevation to the target object. (If this is not adequately achieved, it cannot be safely assumed that the signal detection unit 12 has reached its detection range of +/−2 degrees of angle).

At the same time, there is continuously received information relating to the difference between calculated, initiated compensation data, so-called "set-point values", and actually effected values, so-called "true values", through the medium of the sensors 181–184.

As will be apparent from the aforegoing, it is of utmost importance to invest in quality with respect to the individual sensor units, and then mainly on the 3D-sensors (Vx; Vy; Vz) and (ax; Aay; az) and 2D-inclinometers (x; y) on which the antenna arrangement depends.

The choice of digital components minimises the risk that external signal disturbance signal source will have a negative effect on the function of the antenna arrangement. CAN-Bus technology is able to render the arrangement less sensitive to disturbances and interference and to render said arrangement cost-effective, although it will be understood that this technology is not a prerequisite of the invention.

The illustrated and described exemplifying embodiment of the antenna arrangement is said to include a transceiver horn of a certain, specific kind. It will be understood, however, that the invention is not restricted to this kind of transceiver horn. For instance, the antenna element may comprise a so-called patch antenna with microstrip lines placed in the focal plane of a reflector and covering both the absolute focus of the reflector and also its immediate surroundings.

What is claimed is:

1. An antenna arrangement comprising:

an antenna reflector;

a transceiver element coupled to said antenna reflector;

a signal detection unit and a movement detection unit attached to a rear side of said antenna reflector, said signal detection unit coupled to said transceiver element for processing signals incoming from a target and for generating, responsive to said incoming signals, a first control signal for controlling alignment of the antenna reflector with the target, said signal detection unit including a signal converter and a computing unit in series, said signal converter activating and maintaining a bandwidth at a maximum frequency range until a desired input signal is detected within said bandwidth and then reducing said bandwidth automatically and incrementally from said maximum frequency range to a narrowband frequency range so as to achieve a highest detectable sensitivity for said desired input signal;

said movement detection unit having a signal output connected to a signal input of said computing unit and including a plurality of sensors having three-dimensional sensing capability, said movement detection unit detecting changes in the alignment of said antenna reflector through said three-dimensional sensors and generating a second control signal in response thereto; and a drive unit for controlling alignment of said antenna reflector in response to said first and second control signals.

2. The antenna arrangement as set forth in claim 1, further comprising:

a system control unit coupled between said computing unit and said drive unit;

a second computing unit having an output coupled to said system control unit; and a second movement detection unit having a second plurality of sensors for detecting position changes of each of a plurality of rotational axles due to external forces acting on and within said arrangement, said second movement detection unit having an output connected to said second computing unit for conveying data necessary to continuously compensate for said position changes.

3. The antenna arrangement as set forth in claim 2, further comprising:

a third computing unit having an output coupled to said system control unit; and a third movement detection unit coupled to said third computing unit and having a third plurality of sensors for detecting movement compensation actually effected on each of said rotational axles in response to compensation data initiated by said system control unit, data on said actually effected movement being input to said third computing unit.

4. The antenna arrangement as set forth in claim 1, wherein said three-dimensional sensors include speed sensors for detecting changes in velocity in three dimensions, $\Delta Vx$, $\Delta Vy$, $\Delta Vz$, and acceleration sensors for detecting changes in acceleration in three dimensions, $\Delta ax$, $\Delta ay$, $\Delta az$.

5. The antenna arrangement as set forth in claim 3, wherein said second and third plurality of sensors are placed on said rotational axles.

6. The antenna arrangement as set forth in claim 1, further comprising a three-dimensional sensor unit mounted on a support base of said antenna arrangement for measuring, on a continuous basis, a mechanical flexibility of said arrangement.

7. The antenna arrangement as set forth in claim 1, wherein said signal converter includes a high frequency part and an intermediate frequency part, said high frequency part having an input side connected to said transceiver element and an output side connected to said intermediate frequency part where said bandwidth is automatically and incrementally reduced.

8. An antenna arrangement comprising:

an antenna reflector;

a transceiver element coupled to said antenna reflector;

a signal detection unit and a movement detection unit attached to a rear side of said antenna reflector, said signal detection unit coupled to said transceiver element for processing signals incoming from a target and for generating, responsive to said incoming signals, a first control signal for controlling alignment of the antenna reflector with the target, said detection unit including a signal converter and a computing unit in series, said signal converter activating and maintaining a bandwidth at a maximum frequency range until a desired input signal is detected within said bandwidth and then reducing said bandwidth automatically and incrementally from said maximum frequency range to a narrowband frequency range so as to achieve a highest detectable sensitivity for said desired input signal;

a system control unit coupled to an output of said computing unit and receiving said first control signal;

said movement detection unit having a signal output connected to a signal input of said computing unit and including a plurality of sensors having three-dimensional sensing capability, said movement detection unit detecting changes in the alignment of said antenna reflector through said three-dimensional sensors and generating a second control signal in response thereto for output to said system control unit; and a drive unit coupled to said system control unit for mechanically controlling alignment of said antenna reflector in response to said first and second control signals.

9. The antenna arrangement as set forth in claim 8, further comprising:

a second movement detection unit having a second plurality of sensors for continuously detecting position changes of each of a plurality of rotational axles of said antenna arrangement due to external forces acting on and within said arrangement, said second movement detection unit coupled to said system control unit for conveying information necessary to continuously compensate for said position changes.

10. The antenna arrangement as set forth in claim 9, further comprising:

a third movement detection unit having a third plurality of sensors for detecting movement compensation actually effected on each of said rotational axles in response to compensation data initiated by said system control unit, data on said actually effected movement being input to said system control unit.

11. The antenna arrangement as set forth in claim 8, wherein said three-dimensional sensors include speed sensors for detecting changes in velocity in three dimensions, $\Delta Vx$, $\Delta Vy$, $\Delta Vz$, and acceleration sensors for detecting changes in acceleration in three dimensions, $\Delta ax$, $\Delta ay$, $\Delta az$.

12. The antenna arrangement as set forth in claim 10, wherein said second and third plurality of sensors are placed on said rotational axles.

13. The antenna arrangement as set forth in claim 8, further comprising a three-dimensional sensor unit mounted on a support base of said antenna arrangement for measuring, on a continuous basis, a mechanical flexibility of said antenna arrangement.

14. The arrangement as set forth in claim 8, wherein said signal converter includes a high frequency part and an intermediate frequency part, said high frequency part having an input side connected to said transceiver element and an output side connected to said intermediate frequency part where said bandwidth is automatically and incrementally reduced.

15. The arrangement as set forth in claim 8, wherein said movement detection unit has a superordinate role in relation to said signal detection unit, said signal detection unit correcting output data of said movement detection unit with respect to component drift and instability.

* * * * *